US010429073B2

(12) United States Patent
Davis, III et al.

(10) Patent No.: US 10,429,073 B2
(45) Date of Patent: Oct. 1, 2019

(54) COMBUSTOR CAP MODULE AND RETENTION SYSTEM THEREFOR

(71) Applicant: General Electric Company, Schenectady, NY (US)

(72) Inventors: Charles Lewis Davis, III, Simpsonville, SC (US); Scott Robert Simmons, Greenville, SC (US); David Kenton Felling, Greenville, SC (US)

(73) Assignee: General Electric Company, Schenectady, NY (US)

( * ) Notice: Subject to any disclaimer, the term of this patent is extended or adjusted under 35 U.S.C. 154(b) by 311 days.

(21) Appl. No.: 15/359,044

(22) Filed: Nov. 22, 2016

(65) Prior Publication Data

US 2017/0176016 A1 Jun. 22, 2017

Related U.S. Application Data

(60) Provisional application No. 62/270,188, filed on Dec. 21, 2015.

(51) Int. Cl.
*F23R 3/60* (2006.01)
*F23R 3/28* (2006.01)

(52) U.S. Cl.
CPC ..... *F23R 3/60* (2013.01); *F23R 3/283* (2013.01); *F23R 2900/00017* (2013.01)

(58) Field of Classification Search
CPC .. F23R 3/28; F23R 3/283; F23R 3/286; F23R 3/34; F23R 3/343; F23R 3/346;
(Continued)

(56) References Cited

U.S. PATENT DOCUMENTS 5,274,991 A * 1/1994 Fitts ..... F23R 3/283 60/39.37
5,357,745 A 10/1994 Probert
(Continued)

FOREIGN PATENT DOCUMENTS

EP 2 442 029 A1 4/2012

OTHER PUBLICATIONS

Extended European Search Report and Opinion issued in connection with corresponding EP Application No. 16203745.1 dated May 4, 2017.

*Primary Examiner* — William H Rodriguez
(74) *Attorney, Agent, or Firm* — Frank A. Landgraff; Charlotte C. Wilson; James W. Pemrick

(57) ABSTRACT

A combustor cap module is provided with a retention system to facilitate assembly and disassembly. The combustor cap module further includes a cap face assembly having a cooling plate; a cylindrical sleeve including a connecting surface for attaching the cap face assembly to the retention assembly; and a coupling member mounted in a downstream fuel nozzle opening in the cooling plate. The retention system includes a support plate having an inner panel that defines an upstream fuel nozzle opening. The coupling member extends through the upstream fuel nozzle opening, such that its upstream end extends upstream of the support plate. A retaining ring at least partially encircles the upstream end of the coupling member and is engaged by a spring plate that is removably secured to the support plate at multiple locations. A method for assembling a combustor cap module is also provided.

20 Claims, 8 Drawing Sheets

(58) Field of Classification Search
CPC .... F23R 3/60; F23R 2900/00017; F23R 3/00; F23R 3/002; F23R 3/02; F23R 3/04
See application file for complete search history.

(56) References Cited

U.S. PATENT DOCUMENTS

| | | | | |
|---|---|---|---|---|
| 6,672,073 | B2 | 1/2004 | Wiebe | |
| 8,438,853 | B2 | 5/2013 | Green et al. | |
| 8,528,336 | B2 * | 9/2013 | Cihlar | F23R 3/283 60/740 |
| 8,572,979 | B2 | 11/2013 | Smith et al. | |
| 8,800,288 | B2 | 8/2014 | Kidder et al. | |
| 8,938,976 | B2 * | 1/2015 | Moehrle | F23R 3/60 60/796 |
| 9,003,803 | B2 * | 4/2015 | Pangle | F23R 3/60 60/740 |
| 9,303,873 | B2 * | 4/2016 | Stewart | F23R 3/10 |
| 9,366,445 | B2 | 6/2016 | Stoia et al. | |
| 9,410,447 | B2 * | 8/2016 | Coffin | F01D 25/16 |
| 2009/0188255 | A1 * | 7/2009 | Green | F01D 9/023 60/737 |
| 2010/0242493 | A1 * | 9/2010 | Cihlar | F23R 3/283 60/796 |
| 2014/0338343 | A1 | 11/2014 | Ouellet et al. | |

* cited by examiner

COMBUSTOR CAP MODULE AND RETENTION SYSTEM THEREFOR

CROSS-REFERENCE TO RELATED APPLICATIONS

This application is a non-provisional application, claiming benefit to U.S. Provisional Application Ser. No. 62/270,188, filed Dec. 21, 2015.

BACKGROUND

The present disclosure is related to gas turbine combustion systems and, more specifically, to a combustor cap module having a retention system. According to one aspect, the retention system facilitates assembly and disassembly of the head end. In another aspect, the cap assembly facilitates cooling of the head end, while providing structural support for components (such as fuel nozzles) installed therein.

Heavy duty gas turbines are widely used for power generation. As illustrated schematically in FIG. 1, a typical heavy duty gas turbine includes a compressor section 10, a combustor section 20, a turbine section 30, and a load 40. The compressor section 10 and the turbine section 30 are linked by a common shaft or rotor 12. The compressor section 10 includes multiple stages of rotating blades that compress air, which is provided to the combustor section 20. In the combustor section 20, one or more combustors 22 combusts a mixture of fuel and the compressed air from the compressor section 10 to produce hot combustion gases. The hot combustion gases are directed to the turbine section 30, where the gases drive the rotation of turbine blades in one or more turbine stages. The rotation of the turbine blades drives the shaft 12 to rotate one or more loads 40, e.g., an electrical generator.

The combustor section 20 includes one or more combustors 22, each of which is provided with fuel nozzles to inject fuel and air into a combustor. The fuel nozzles of an individual combustor 22 are contained within a cap assembly. The cap assembly directs the flow of air used for combustion and cooling. One of the challenges in producing such cap assemblies is directing air flow used for combustion and cooling, while maintaining a structure capable of withstanding high vibration loads. Additionally, the design and construction of the cap assembly can significantly affect the time, cost, and complexity of installation, removal, maintenance, and general servicing. Thus, a cap assembly designed as a module for structural stability and installation efficiency would represent an advancement over the current art, which relies heavily on permanent (e.g., welded) joints between the respective components.

SUMMARY

Certain embodiments commensurate in scope with the originally claimed embodiment are summarized below. These embodiments are not intended to limit the scope of the claimed embodiment, but rather these embodiments are intended only to provide a brief summary of possible forms of the embodiment.

In a first embodiment, a combustor cap module includes a cap face assembly and a retention system. The cap face assembly includes a cooling plate that defines at least one downstream fuel nozzle opening within which a coupling member is positioned. The coupling member has a downstream end permanently affixed within a respective one of the at least one downstream fuel nozzle openings. A cylindrical sleeve is attached to a perimeter of the cooling plate and projects upstream therefrom. The cylindrical sleeve has a connecting surface opposite the cooling plate. The retention system includes a support plate having a downstream surface attached to the connecting surface; a retaining ring encircling an upstream end of the coupling member, the upstream end extending upstream of the support plate; and a spring plate enclosing the retaining ring and engaging the upstream end of the coupling member, the spring plate being removably attached to the support plate. The support plate defines a radially inward area within which at least one upstream fuel nozzle opening is defined. The at least one upstream fuel nozzle opening in the radially inward area and the at least one downstream fuel nozzle opening in the cooling plate, which are sized to support a fuel nozzle therein, are aligned with one another.

In a second embodiment, a combustor cap module retention system is provided. The retention system includes a support plate, a retaining ring, and a spring plate. The support plate has a radially inner panel and one or more openings defined within the inner panel for supporting one or more fuel nozzles therethrough. The plurality of openings includes a center fuel nozzle opening and may further include an outer fuel nozzle opening. The retaining ring at least partially encircles an upstream end of a coupling member, which is fixedly attached to a cap face assembly. The spring plate encloses the retaining ring and engages the coupling member and is removably secured to the support plate at multiple locations.

In a third embodiment, a method of producing a combustor cap module is provided. The method includes providing a cap face assembly including a cooling plate defining a downstream fuel nozzle opening; a coupling member having a downstream end fixedly mounted within the downstream fuel nozzle opening; and a connecting surface opposite the cooling plate, wherein the cooling plate and the connecting surface are joined to a cylindrical sleeve positioned therebetween. The method further includes engaging a retention system with the cap face assembly by: positioning the coupling member through a corresponding upstream fuel nozzle opening in a support plate, such that an upstream end of the coupling member extends upstream of the support plate; encircling the upstream end of the coupling member with a retaining ring; and enclosing the retaining ring and engaging the coupling member by removably securing a spring plate to the support plate.

BRIEF DESCRIPTION OF THE DRAWINGS

These and other features, aspects, and advantages of the present embodiment will become better understood when the following detailed description is read with reference to the accompanying drawings, wherein.

DETAILED DESCRIPTION

This written description uses examples to disclose the embodiment, including the best mode, which are intended to enable any person skilled in the art to practice the embodiment, including making and using any devices and systems and performing any incorporated methods. The patentable scope of the embodiment is defined by the claims and may include other examples that occur to those skilled in the art. Such other examples are intended to fall within the scope of the claims if they have structural elements that do not differ from the literal language of the claims, or if they include equivalent structural elements with insubstantial differences from the literal language of the claims.

When introducing elements of various embodiments, the articles "a", "an", and "the" are intended to mean that there are one or more of the elements. The terms "comprising," "including," and "having" are intended to be inclusive and mean that there may be additional elements other than the listed elements.

As used herein, the terms "upstream" and "downstream" are directional terms used to describe the location of components relative to the flow of combustion products through the combustor from an upstream end to a downstream end. Upstream components are located on or toward the forward, or head, end of the combustor and are closer to the compressor section, while downstream components are located on or toward the aft end of the combustor and are closer to the turbine section.

The present disclosure is directed to a combustor cap module and to a retention system therefor. This disclosure provides a simplified means for retaining a cap face assembly within a gas turbine combustor, by providing a rigid structural joint that requires only hand tools for installation. By using this retention system, the time, cost, and complexity of assembling and disassembling a cap assembly are significantly reduced. It is estimated that, when compared to a conventional cap assembly with welded joints between components, the assembly, or disassembly, time is reduced by approximately 2 hours per combustor. For a gas turbine having fourteen combustor cans, the time savings is about 28 hours. Thus, more than a day of assembly time or down-time (in the case of maintenance) is eliminated, directly impacting the bottom-line of the gas turbine operator.

Figure 3:
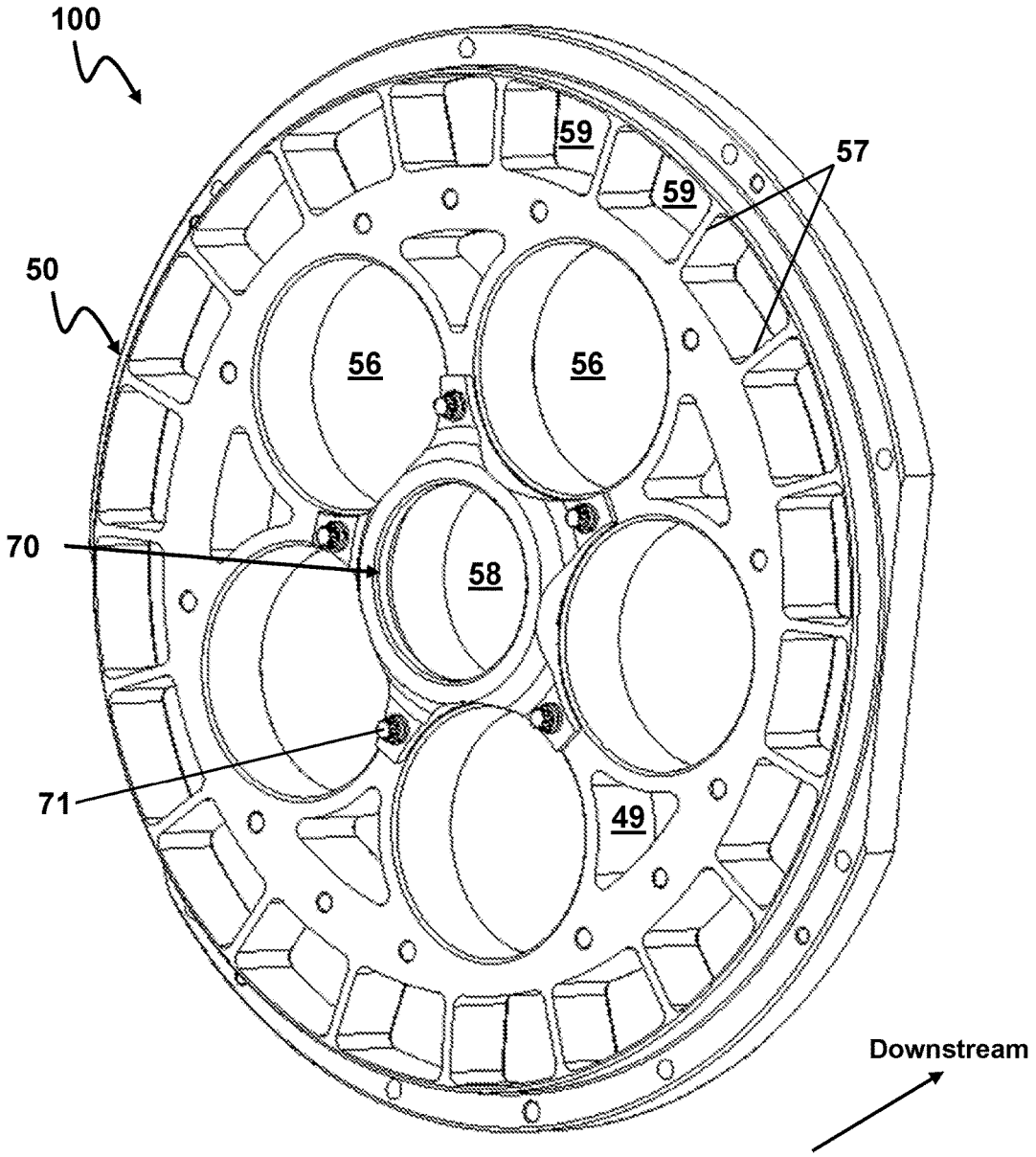
FIG. 3 is a perspective view of a retention system, including the support plate of FIG. 2, which may be used in a combustor cap module described herein.

The combustor cap module includes a cap face assembly (shown in FIG. 5) and a retention system (shown in FIG. 3). The cap face assembly includes a cooling plate (e.g., an effusion plate) that defines at least one and, in some embodiments, a plurality of downstream fuel nozzle openings. A cylindrical sleeve is attached to the cooling plate and projects upstream therefrom. The cylindrical sleeve has a connecting surface opposite the cooling plate, which is connected to a downstream surface of a support plate of the retention system. A coupling member is fixedly installed within one of the downstream fuel nozzle openings and projects upstream beyond the connecting surface.

The retention system includes a support plate, a retaining ring, and a spring plate. The support plate has at least one and, in some embodiments, a plurality of upstream fuel nozzle openings defined within a radially inward panel of the support plate for supporting fuel nozzles therethrough. The downstream fuel nozzle openings and the upstream fuel nozzle openings are aligned and include a center fuel nozzle opening and an outer fuel nozzle opening in both the cooling plate and the support plate. The coupling member is positioned within the center fuel nozzle opening and has a first (upstream) end that projects upstream of the support plate. The retaining ring at least partially encircles the first end of the coupling member. The spring plate encloses the retaining ring and engages the coupling member and is secured to the support plate at multiple locations.

The combustor cap module is configured to withstand both turbine frequencies and combustion dynamics frequencies. The natural resonant frequency of the combustor cap module is higher than the expected turbine and combustion dynamics frequencies, thereby reducing the risk of the combustor cap module being driven by frequencies occurring in the gas turbine. The cylindrical sleeve, in combination with the retained coupling member, provide the necessary structural robustness to the combustor cap module.

Figure 1:
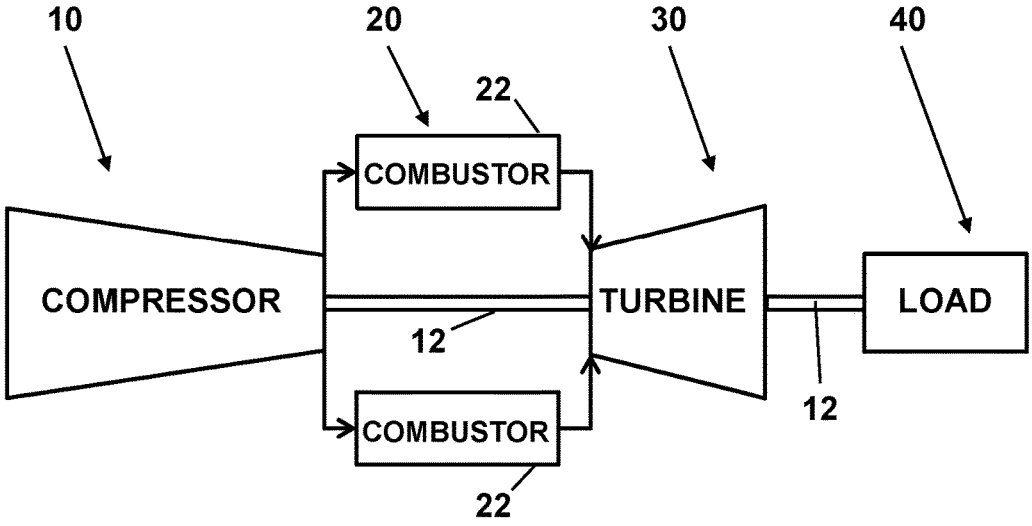
FIG. 1 PRIOR ART
FIG. 1 is a block diagram of an exemplary gas turbine system, according to the prior art.
Figure 2:
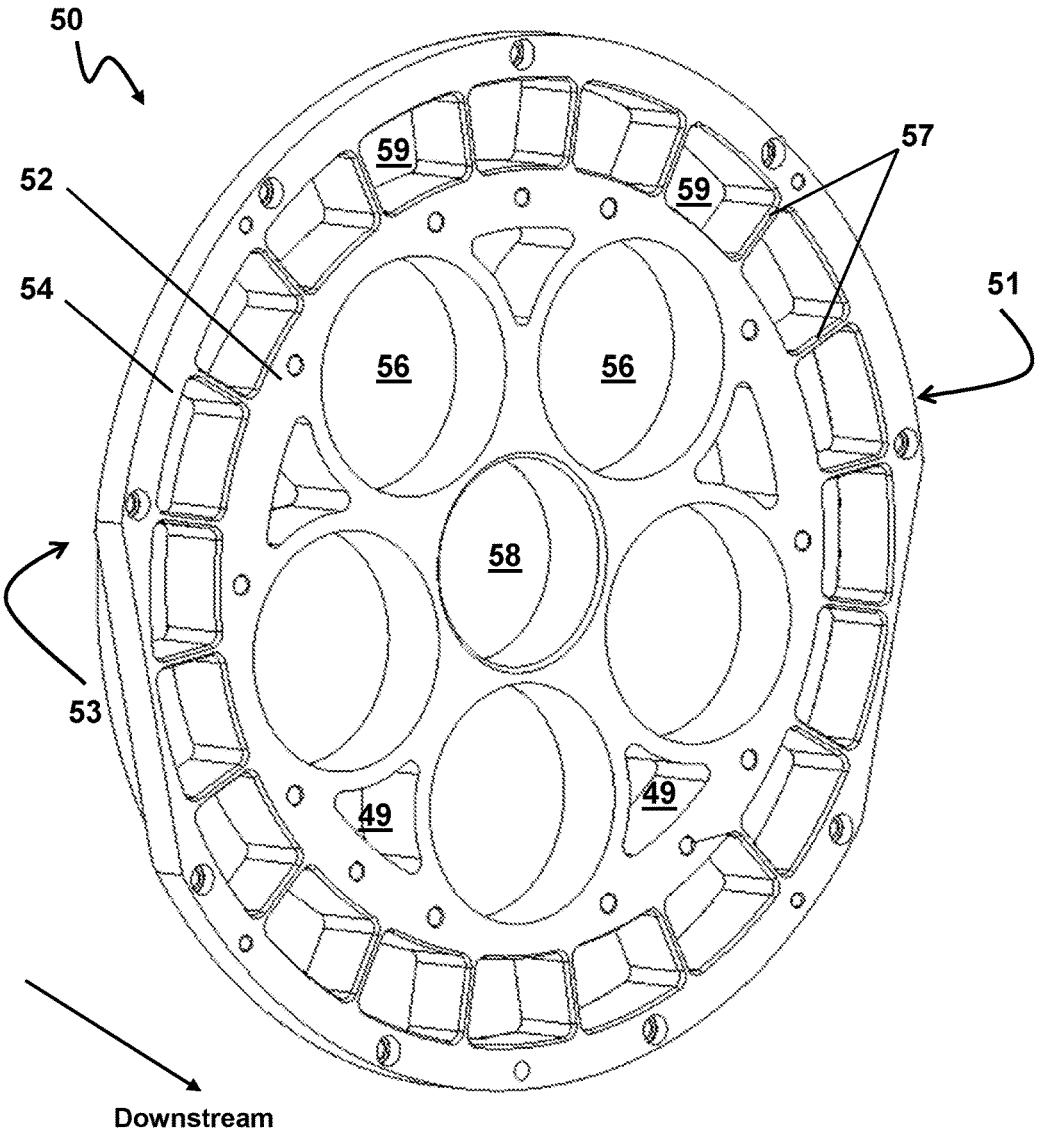
FIG. 2 is a perspective view of a downstream surface of a support plate, according to an aspect of the present disclosure.

Turning now to the Figures, FIG. 2 illustrates a support plate 50 that is included within a retention system 100 of the present disclosure (shown in FIG. 3). The downstream surface 51 of the support plate 50 is shown. The support plate 50 includes a radially inward panel 52 that defines at least one fuel nozzle opening. In the embodiment shown, the radially inward panel 52 defines a number of fuel nozzle openings, which include multiple outer fuel nozzle openings 56 and a center fuel nozzle opening 58. Because the support plate 50, when assembled, is upstream of the cap assembly, the fuel nozzle openings 56, 58 may subsequently be referred to herein and in the claims as "at least one upstream fuel nozzle opening."

To provide sufficient strength to the cap assembly 120 (shown in FIGS. 6, 7, and 8), the support plate 50 may include a number of struts 57 that extend radially outward from the inner panel 52 to a radially outer ring 54.

The struts 57 define between them air flow passages 59, which serve to straighten or condition the air flow traveling to the head end of the combustor. To reduce weight, to mitigate combustion dynamics, and to improve air flow to the cap assembly 120, the inner panel 52 may further define auxiliary air flow passages 49 therein. In the embodiment shown, the auxiliary air flow passages 49 are generally triangular in shape and located between adjacent outer fuel nozzle openings 56. However, it should be understood that the auxiliary air flow passages 49 may be shaped, sized, or located differently from the exemplary embodiment shown in the Figures.

As illustrated, the center fuel nozzle opening 58 is surrounded by five outer fuel nozzle openings 56. However, it should be understood that other numbers of outer fuel nozzle openings 56 may be used, as correspond to the number of fuel nozzles to be used in the combustor. For example, the inner panel 52 of the support plate 50 may include from three to eight outer fuel nozzle openings 58 for a corresponding number of fuel nozzles.

Also, as illustrated, the diameter of the center fuel nozzle opening 58 is smaller than the diameter of the outer fuel nozzle openings 56. However, it should be understood that the fuel nozzle openings 56, 58 may have equal diameters, or the diameter of the center fuel nozzle opening 58 may be larger than the diameter of the outer fuel nozzle openings 56. Likewise, although the fuel nozzle openings 56, 58 are shown as having a circular shape, there is no requirement that the fuel nozzle openings 56, 58 have this shape.

A retention system 100 including the support plate 50 is shown in FIG. 3. The retention system 100 engages a coupling member 60 (visible in FIG. 5) that is positioned within a corresponding center fuel nozzle opening 88 of a cooling plate 82 (visible in FIG. 6). As used herein with respect to the coupling member 60, the phrases "positioned within" or "attached within" refer to the securing of the downstream end of the coupling member 60 directly to the center fuel nozzle opening 88 or proximate the center fuel nozzle opening 88, for example, by securing the coupling member 60 to a corresponding piston ring housing 89 immediately upstream of the center fuel nozzle opening 88.

Figure 5:
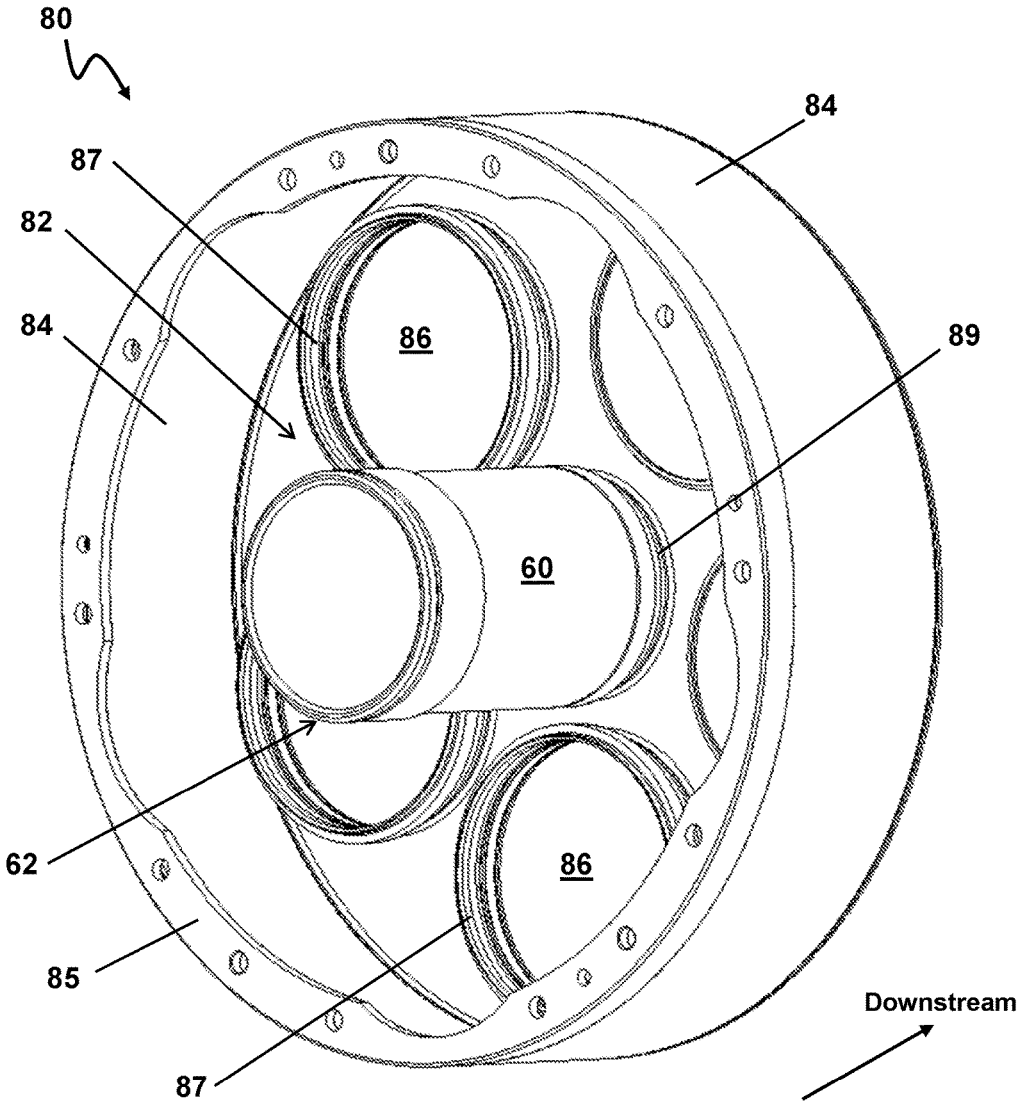
FIG. 5 is a perspective view of upstream surfaces of a cap face assembly, according to another aspect of the present disclosure.

The coupling member 60 has a generally cylindrical, or tube, shape with a first (upstream) end and a second (downstream) end. The first (upstream) end of the coupling member 60 projects upstream of the support plate 50 when the combustor cap module 120 (shown in FIG. 6) is assembled. The second (downstream) end of the coupling member 60 is welded, or otherwise permanently or fixedly joined, to the cap face assembly 80 (as shown in FIG. 5), and the upstream end of the coupling member 60 is further secured in the center fuel nozzle opening 58 by a retaining ring 90 (shown in FIGS. 7 and 8), which fits into a groove 62 on an outer surface of the upstream end of the coupling member 60. The retaining ring 90 may be a spiral ring, which limits the axial movement of the coupling member 60.

Figure 4:
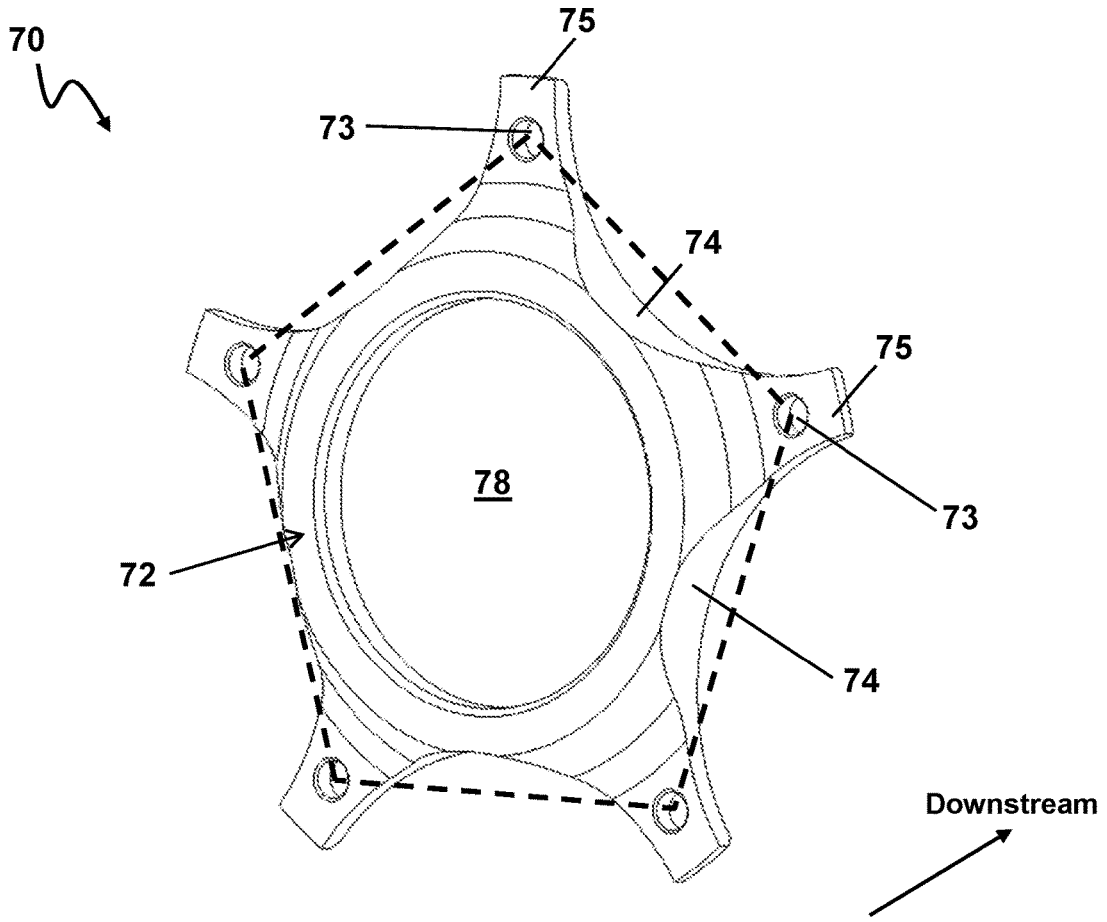
FIG. 4 is a perspective view of a spring plate, as used in the retention system of FIG. 3.

To further secure the coupling member 60, a spring plate 70 encloses the retaining ring 90 and engages the upstream end of the coupling member 60. The spring plate 70, the upstream side of which is seen more clearly in FIG. 4, has a circular center portion 72 and a plurality of arcuate edge portions 74 surrounding the circular center portion 72. The circular center portion 72 defines an opening 78 which receives the coupling member 60 and, ultimately, through which the center fuel nozzle (not shown) is positioned.

Each of the arcuate edge portions 74 corresponds to a portion of a profile (i.e., an arc) of one of the outer fuel nozzle openings 56. In the exemplary embodiment shown, the circular center portion 72 projects upstream from the support plate 50 a first distance (labeled 172 in FIG. 8), and the arcuate edge portions 74 project upstream from the support plate 50 a second distance (labeled 174 in FIG. 8). To accommodate and secure the upstream end of the coupling member 60, which projects through the central opening 78, the first distance 172 is greater than the second distance 174. Alternately, the spring plate 70 may have a uniform thickness. In yet another variation, the spring plate 70 may be configured to fit within a recess in the support plate 50, in which case the center portion 72 and the arcuate edge portions 74 may have any desired thickness compatible with the recess.

Figure 7:
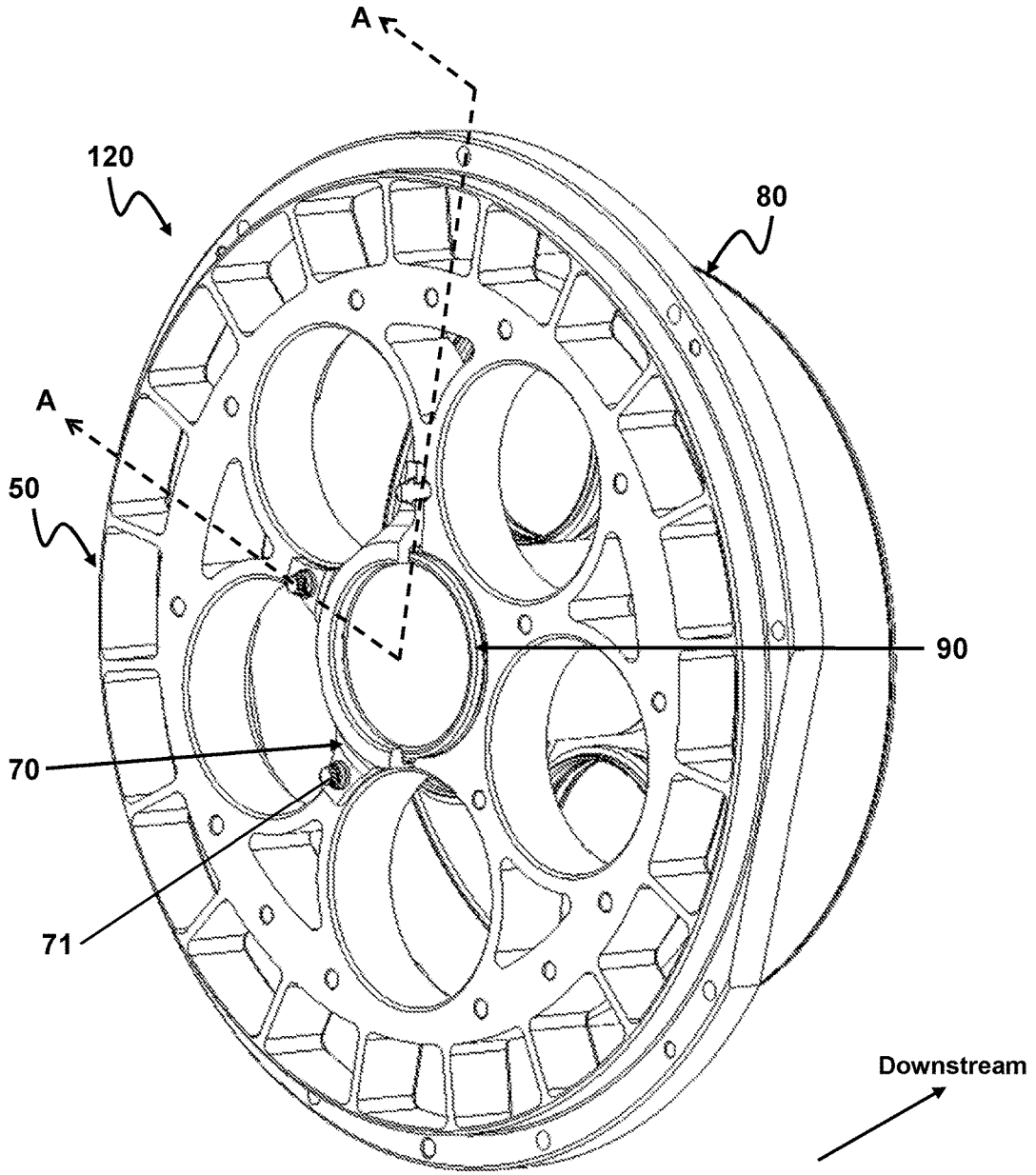
FIG. 7 is a perspective view of upstream surfaces of the combustor cap module of FIG. 6.
Figure 8:
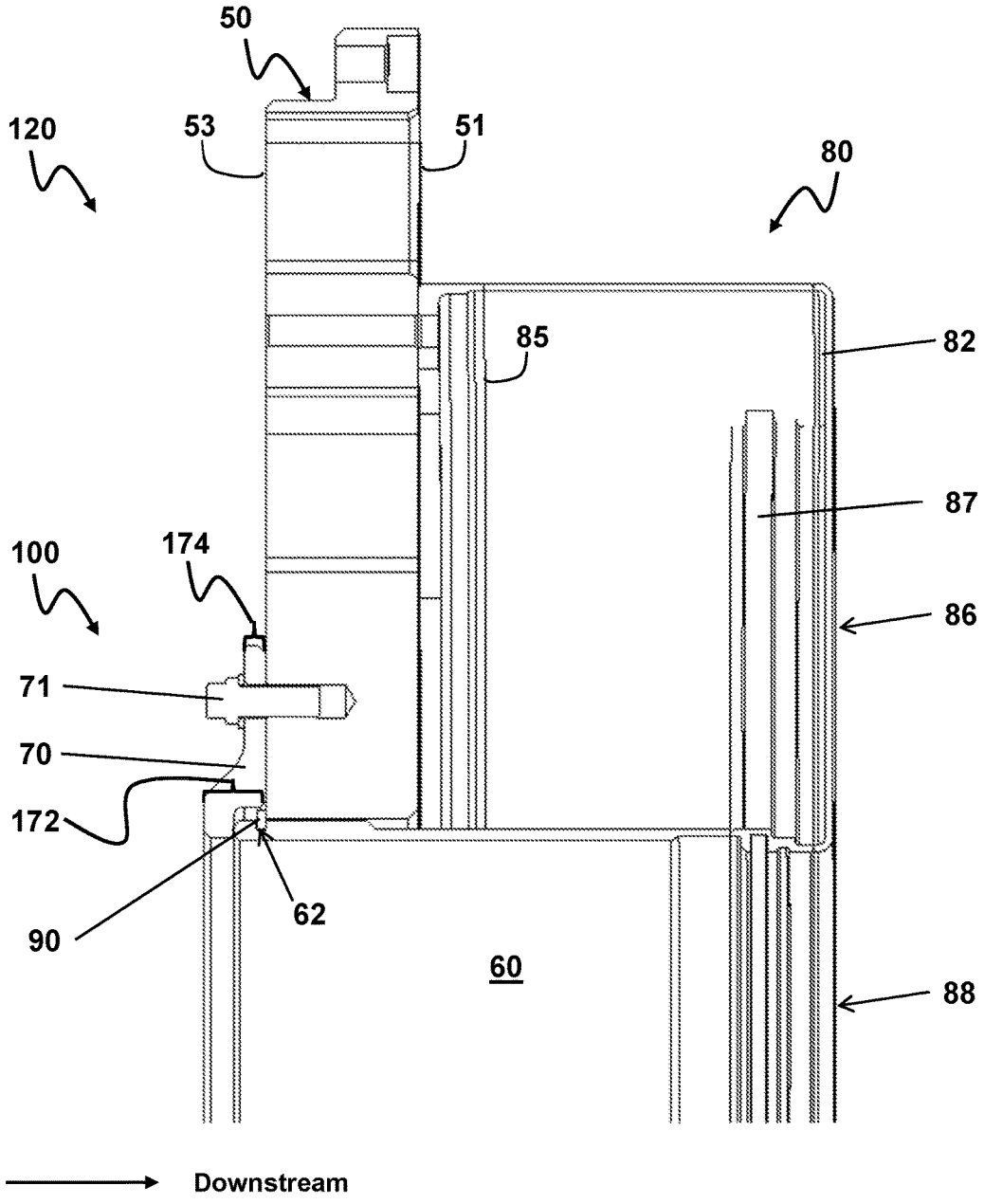
FIG. 8 is a cross-sectional view of the combustor cap module of FIG. 7, as taken along line A-A.

At each tab 75 where the arcuate edge portions 74 are joined, the spring plate 70 defines a bolt hole 73 therethrough. The bolt holes 73 define the points of a regular polygon (e.g., a regular pentagon, as shown in dashed lines in FIG. 4). The spring plate 70 is secured to the support plate 50 by bolts 71, as shown in FIGS. 7 and 8.

In the exemplary spring plate 70 shown, the number of arcuate edge portions 74 and the number of bolt holes 73 corresponds to the number of outer fuel nozzle openings 56, 86. It should be appreciated that there is no such requirement for the number of edge portions 74 and/or bolt holes 73 to correspond in a 1:1 ratio to the number of outer fuel nozzle openings 56, 86. It is believed that the spring plate 70 may be secured to the support plate 50 by as few as three bolts 71, in which case, as with the exemplary spring plate 70 illustrated herein, the bolt holes 73 define the points of a triangle.

In embodiments where the number of outer fuel nozzle openings 56, 86 is more than five, the spring plate 70 may include a smaller number of arcuate edge portions 74 and corresponding bolt holes 73. For example, in an embodiment with six (or eight) outer fuel nozzle openings 56, 86, the spring plate 70 may have three (or four) arcuate edge portions 74 and bolt holes 73 in corresponding tabs 75. In such instances, the bolt holes 73 may define a triangle or square. Alternately, if bolt holes 73 are located at each tab 75 between arcuate edge portions 74, the bolt holes 73 may define a regular hexagon or octagon.

FIG. 5 illustrates, from an upstream view, a cap face assembly 80 that forms the face of the combustor cap module 120. The cap face assembly 80 includes a cooling plate 82, which includes a number of holes therethrough (not shown) for cooling of the cap module 120. In one embodiment, the cooling plate 82 may be an effusion plate for effusion cooing of the cap face. The cooling plate 82 includes (downstream) outer fuel nozzle openings 86 and a (downstream) center fuel nozzle opening 88 (visible in FIG. 6). Each of the fuel nozzle openings 86, 88 may be provided with a piston ring housing 87, 89 (89 visible in FIG. 6). The coupling member 60 is secured, at its downstream end, to the piston ring housing (89) of the center fuel nozzle opening 88 and projects upstream for joining to the support plate 50. The outer surface of the upstream end of the coupling member 60 is provided with a groove 62, which receives the retaining ring 90 (shown in FIGS. 7 and 8), thus assisting in retaining the cap face assembly 80 to the support plate 50.

A cylindrical sleeve 84 is attached to the cooling plate 82 and projects upstream therefrom. The cylindrical sleeve 84 has a connecting surface 85 opposite the cooling plate 82, which is connected to a downstream surface 51 of the support plate 50 of the retention system 100 (as shown in FIG. 8). The cylindrical sleeve 84 spans the axial distance between the cooling plate 82 and the connecting surface 85.

Figure 6:
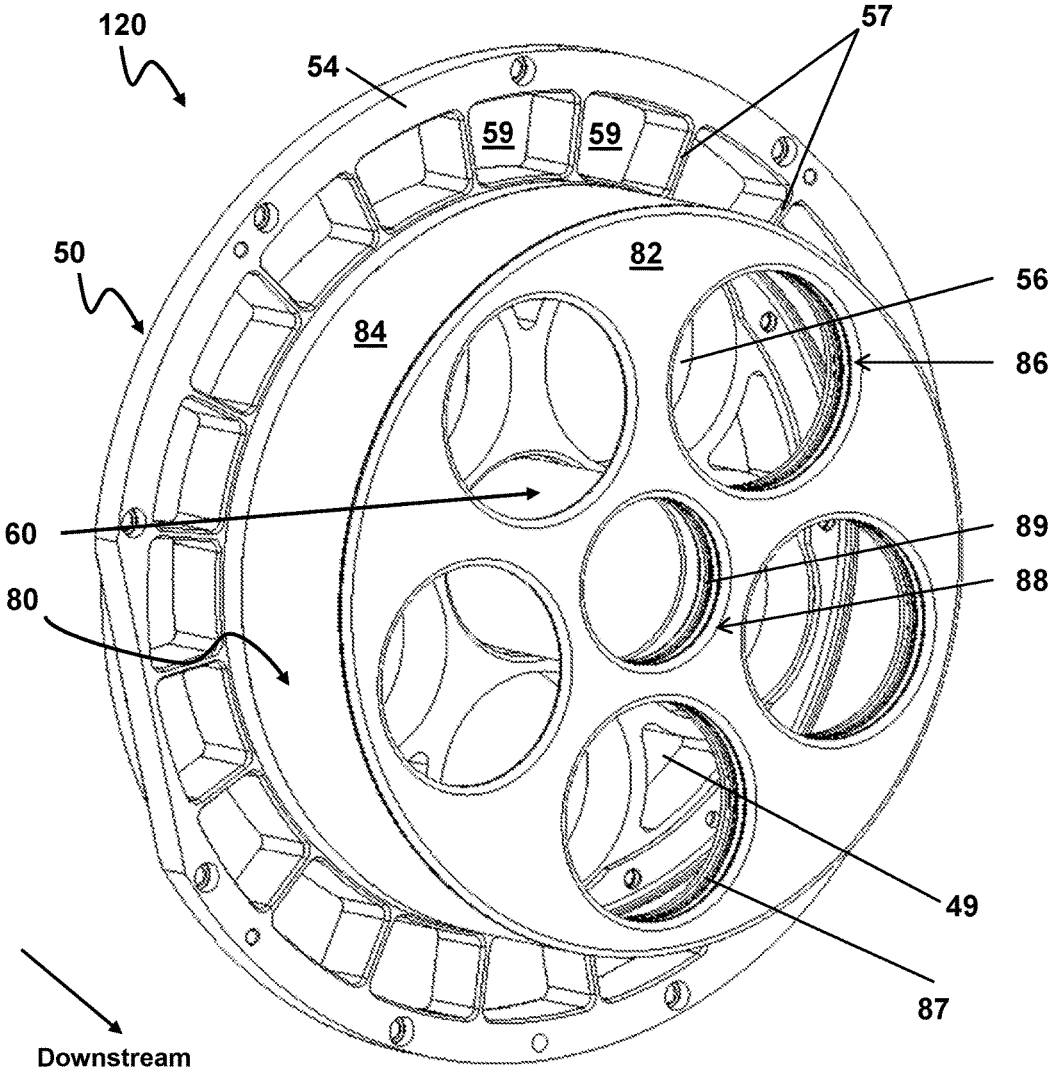
FIG. 6 is a perspective view of downstream surfaces of the combustor cap module of the present disclosure.

FIGS. 6, 7, and 8 illustrate the present combustor cap module 120, which includes the retention system 100 and the cap face assembly 80. FIG. 6 is a view of the cap module 120, as viewed in the upstream direction (that is, viewing the downstream surfaces of the module 120). FIG. 7 is a view of the cap module 120, as viewed from the downstream direction (that is, observing the upstream surfaces of the module 120). FIG. 8 is a cross-sectional view of the assembly 120, as taken along line A-A of FIG. 7.

As is evident from FIGS. 6 and 7, the (upstream) outer fuel nozzle openings 56 in the support plate 50 are aligned with the (downstream) outer fuel nozzle openings 86 in the cooling plate 82. Likewise, the (upstream) center fuel nozzle opening 58 in the support plate 50 is aligned with the (downstream) center fuel nozzle opening 88 in the cooling plate 82. Given the position of the support plate 50 and the cooling plate 82 relative to the fluid flows through the combustor cap module 120, the fuel nozzle openings 56, 58 in the support plate 50 may be described as the upstream fuel nozzle openings, while the fuel nozzle openings 86, 88 in the cooling plate 82 may be described as the downstream fuel nozzle openings.

FIG. 8 shows the attachment of the retention assembly 100 with the cap face assembly 80. The connecting surface 85 is bolted, or otherwise removably attached, to the downstream surface 51 of the support plate 50 of the retention assembly 100. The outer fuel nozzle openings 86 may be provided with piston ring housings 87 to support the fuel nozzles (not shown). The coupling member 60 has a first end that projects upstream from the upstream surface 53 of the support plate 50 and a second end that is located within the center fuel nozzle opening 88 in the cooling plate 82. As described above, the outer surface of the coupling member 60 includes a groove 62 toward the first end thereof, within which the retaining ring 90 is positioned and held.

In assembly, the second end of coupling member 60 is welded, or otherwise permanently joined or affixed, to the piston ring housing 89 of the center fuel nozzle opening 88 in the cooling plate 82. The support plate 50 is then aligned with the cap face assembly 80, such that the first end of the coupling member 60 is positioned through the center fuel nozzle opening 58 of the support plate 50 and extends in an upstream direction. In the embodiment shown, the coupling member 60 extends slightly upstream of the upstream surface 53 of the support plate 50. The retaining ring 90 is positioned in the groove 62 in the first end of the coupling member 60. The spring plate 70 is then bolted to the support plate 50, using bolts 71, thereby enclosing the retaining ring 90 and engaging the first end of the coupling member 60. The distance between the groove 62 and the upstream surface 53 of the support plate 50 is such that, when the spring plate 70 is secured, the retaining ring 90 contacts both the upstream surface 53 of the support plate 50 and the groove 62.

Alternately, as discussed above, the support plate 50 may be provided with a recess surrounding the center fuel nozzle opening 58. In this instance, it may not be necessary for the coupling member 60 to extend upstream of the support plate 50. Rather, it should be understood that the method of securing the cap face assembly 80 using a coupling member 60, retaining ring 90, and spring plate 70 is applicable to numerous configurations that may vary the axial location of the spring plate 70.

Thus, a method of producing a combustor cap module includes providing a cap face assembly including a cooling plate defining a downstream fuel nozzle opening; a coupling member having a downstream end fixedly mounted within the downstream fuel nozzle opening; and a connecting surface opposite the cooling plate, wherein the cooling plate and the connecting surface are joined to a cylindrical sleeve positioned therebetween. The method further includes engaging a retention system with the cap face assembly by: positioning the coupling member through a corresponding upstream fuel nozzle opening in a support plate, such that an upstream end of the coupling member extends upstream of the support plate; encircling the upstream end of the coupling member with a retaining ring; and enclosing the retaining ring and engaging the coupling member by removably securing a spring plate to the support plate.

The present disclosure provides a simplified retention system for a cap face module within a gas turbine combustor. The retention system provides high stiffness and load carrying capability; does not block air flow to and through the head end; and may be installed and uninstalled simply, using only hand tools. In particular, the spring plate is bolted to the support plate after engaging the coupling member and enclosing the retaining ring that encircles the coupling member. This retention system is readily removable, especially as compared to more permanent joining methods, such as welding. Removal of the spring plate bolts and retaining ring provides easy access to the cap face assembly. As such, the subject retention system and the resulting cap module represent advancements in the art.

This written description uses examples to disclose the embodiment, including the best mode, and to enable any person skilled in the art to practice the embodiment, including making and using any devices or systems and performing any incorporated methods. The patentable scope of the embodiment is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A retention system for a combustor cap face assembly, the retention system comprising:

a support plate, the support plate having a radially inner panel and a first fuel nozzle opening defined within the inner panel for supporting a first fuel nozzle therethrough;

a retaining ring at least partially encircling an upstream end of a cylindrical coupling member, the cylindrical coupling member having a downstream end fixedly attached to a center fuel nozzle opening defined in a cooling plate of the combustor cap face assembly, the cylindrical coupling member extending from the cooling plate to upstream of the support plate; and a spring plate encircling the retaining ring and engaging the coupling member, the spring plate being secured to the support plate at multiple locations.

2. The retention system of claim 1, wherein the radially inner panel is surrounded by a radially outer ring, the radially inner panel and the radially outer ring being connected by a plurality of struts extending therebetween; and wherein adjacent struts define therebetween an air flow passage.

3. The retention system of claim 1, wherein the spring plate is secured to the support plate by bolts.

4. The retention system of claim 1, wherein the inner panel of the support ring defines a plurality of openings, the plurality of openings surrounding the first fuel nozzle opening; and wherein the plurality of openings includes between three and eight openings, and the spring plate is secured to the support plate at three or more locations that define a regular polygon.

5. The retention system of claim 4, wherein the plurality of openings includes five outer fuel nozzle openings located radially outward from the first fuel nozzle opening, and the spring plate is secured to the support plate at five locations that define a regular pentagon.

6. The retention system of claim 5, wherein the spring plate comprises a circular center portion and a plurality of arcuate edge portions surrounding the circular center portion, each of the arcuate edge portions corresponding to an arc defined by one of the outer fuel nozzle openings; and wherein adjacent arcuate edge portions are joined at a respective tab, each respective tab defining a bolt hole therethrough, each bolt hole being one of the five locations at which the spring plate is secured to the support plate.

7. The retention system of claim 6, wherein the circular center portion projects upstream from the support plate a first distance; wherein the arcuate edge portions project upstream from the support plate a second distance that is smaller than the first distance; and wherein a surface of the spring plate tapers from the circular center portion to each respective tab.

8. The retention system of claim 1, wherein the upstream end of the coupling member defines a groove therein, the retaining ring fitting within the groove.

9. A combustor cap module comprising:

a cap face assembly, the cap face assembly comprising a cooling plate defining therethrough a first downstream fuel nozzle opening; a cylindrical sleeve attached to a perimeter of the cooling plate and projecting upstream therefrom, the cylindrical sleeve having a connecting surface opposite the cooling plate; and a cylindrical coupling member having a downstream end fixedly attached within the first downstream fuel nozzle opening and having an upstream end projecting upstream beyond the connecting surface; and a retention system comprising:

a support plate, the support plate having a radially inner panel and a first upstream fuel nozzle opening defined within the inner panel for supporting a first fuel nozzle therethrough, the first downstream fuel nozzle opening and the first upstream fuel nozzle opening being aligned with one another;

a retaining ring at least partially encircling the upstream end of the coupling member; and a spring plate engaging the retaining ring and the coupling member, the spring plate being removably secured to the support plate at multiple locations; and wherein the connecting surface of the cap face assembly is connected to a downstream surface of the support plate.

10. The combustor cap module of claim 9, wherein the radially inner panel is surrounded by a radially outer ring, the inner panel and the radially outer ring being connected by a plurality of struts extending therebetween; and wherein adjacent struts define therebetween an air flow passage.

11. The combustor cap module of claim 9, wherein the spring plate is secured to the support plate by bolts.

12. The combustor cap module of claim 9, wherein the support plate and the cooling plate each define a respective plurality of upstream fuel nozzle openings and downstream fuel nozzle openings, the plurality of upstream fuel nozzle openings surrounding the first upstream fuel nozzle opening and the plurality of downstream fuel nozzle openings surrounding the first downstream fuel nozzle opening; and wherein the plurality of upstream openings and the plurality of downstream openings each includes between three and eight openings, and the spring plate is secured to the support plate at three or more locations that define a polygon.

13. The combustor cap module of claim 12, wherein the plurality of upstream openings includes five outer fuel nozzle openings surrounding the first upstream fuel nozzle opening; wherein the plurality of downstream openings includes five outer fuel nozzle openings surrounding the first downstream fuel nozzle opening; and wherein the spring plate is secured to the support plate at five locations that define a regular pentagon.

14. The combustor cap module of claim 13, wherein the spring plate comprises a circular center portion and a plurality of arcuate edge portions surrounding the circular center portion, each of the arcuate edge portions corresponding to an arc defined by one of the outer fuel nozzle openings; and wherein adjacent arcuate edge portions are joined at a respective tab, each respective tab defining a bolt hole therethrough, each bolt hole being one of the five locations at which the spring plate is secured to the support plate.

15. The combustor cap module of claim 14, wherein the circular center portion projects upstream from the support plate a first distance; wherein the arcuate edge portions project upstream from the support plate a second distance that is smaller than the first distance; and wherein a surface of the spring plate tapers from the circular center portion to each respective tab.

16. The combustor cap module of claim 9, wherein an outer surface of the upstream end of the coupling member defines a groove therein, the retaining ring fitting within the groove.

17. The combustor cap module of claim 9, wherein the downstream end of the coupling member is permanently attached to a piston ring housing located in the first fuel nozzle opening.

18. A method of producing a combustor cap module, the method comprising:

providing a cap face assembly comprising a cooling plate defining a downstream fuel nozzle opening therethrough; a cylindrical coupling member having a downstream end fixedly mounted within the downstream fuel nozzle opening; and a connecting surface opposite the cooling plate, wherein the cooling plate and the connecting surface are joined to a cylindrical sleeve positioned therebetween; and engaging a retention system with the cap face assembly by:

positioning the cylindrical coupling member through a corresponding upstream fuel nozzle opening in a support plate, such that an upstream end of the cylindrical coupling member extends upstream of the support plate;

encircling the upstream end of the cylindrical coupling member with a retaining ring; and enclosing the retaining ring and engaging the cylindrical coupling member by removably securing a spring plate to the support plate.

19. The method of claim 18, further comprising: defining a groove in the upstream end of the cylindrical coupling member; and wherein the encircling of the upstream end of the cylindrical coupling member results in the retaining ring being positioned within the groove.

20. The method of claim 18, wherein the removably securing the spring plate to the support plate is accomplished by bolts.

* * * * *